US008659521B2

(12) United States Patent
Osame et al.

(10) Patent No.: US 8,659,521 B2
(45) Date of Patent: Feb. 25, 2014

(54) DISPLAY DEVICE HAVING A PLURALITY OF DRIVING TRANSISTORS AND A LIGHT EMITTING ELEMENT AND METHOD FOR DRIVING THE SAME

(75) Inventors: Mitsuaki Osame, Kanagawa (JP); Mizuki Sato, Kanagawa (JP)

(73) Assignee: Semiconductor Energy Laboratory Co., Ltd. (JP)

( * ) Notice: Subject to any disclaimer, the term of this patent is extended or adjusted under 35 U.S.C. 154(b) by 928 days.

(21) Appl. No.: 11/581,593

(22) Filed: Oct. 16, 2006

(65) Prior Publication Data

US 2007/0091035 A1 Apr. 26, 2007

(30) Foreign Application Priority Data

Oct. 21, 2005 (JP) ..... 2005-307906

(51) Int. Cl.
*G09G 3/32* (2006.01)

(52) U.S. Cl.
USPC ..... 345/82; 345/76

(58) Field of Classification Search
USPC ..... 345/76–82; 315/169.3
See application file for complete search history.

(56) References Cited

U.S. PATENT DOCUMENTS

| | | | | |
|---|---|---|---|---|
| 6,847,341 | B2 | 1/2005 | Kimura et al. | |
| 6,909,242 | B2 | 6/2005 | Kimura | |
| 7,184,034 | B2 | 2/2007 | Kimura | |
| 7,511,687 | B2 | 3/2009 | Kimura | |
| 7,583,032 | B2 | 9/2009 | Kimura | |
| 7,852,297 | B2 | 12/2010 | Kimura | |
| 7,928,945 | B2 | 4/2011 | Kimura et al. | |
| 8,130,173 | B2 | 3/2012 | Deane et al. | |
| 2001/0035849 | A1 | 11/2001 | Kimura et al. | |
| 2002/0018029 | A1 | 2/2002 | Koyama | |
| 2002/0047555 | A1* | 4/2002 | Inukai | 315/169.3 |
| 2002/0154151 | A1* | 10/2002 | Koyama | 345/690 |
| 2003/0146712 | A1* | 8/2003 | Inukai | 315/169.3 |
| 2003/0174009 | A1* | 9/2003 | Kimura et al. | 327/427 |
| 2004/0004443 | A1* | 1/2004 | Park et al. | 315/169.1 |
| 2004/0036683 | A1 | 2/2004 | Senda | |
| 2004/0263440 | A1* | 12/2004 | Kimura et al. | 345/76 |
| 2004/0263499 | A1 | 12/2004 | Tanada et al. | |
| 2005/0007361 | A1 | 1/2005 | Fujikura et al. | |

(Continued)

FOREIGN PATENT DOCUMENTS

| | | |
|---|---|---|
| EP | 1 296 310 A2 | 3/2003 |
| JP | 2002-006808 | 1/2002 |
| JP | 2003-66909 | 3/2003 |
| JP | 2003-150104 | 5/2003 |

(Continued)

OTHER PUBLICATIONS

Office Action re Korean application No. KR 10-2006-0102373, dated Apr. 12, 2013 (with English translation).

*Primary Examiner* — Long D Pham
(74) *Attorney, Agent, or Firm* — Husch Blackwell LLP

(57) ABSTRACT

When a time grayscale method is used, it is an object to provide a display device in which the number of signal writings into a pixel can be reduced by dividing one frame period by the number of bits and power consumption can be reduced, and grayscale can be expressed. Further a smaller electronic device that performs display by a time grayscale method can be obtained. Grayscale can be expressed by dividing one frame period into subframe periods without storing signals by grayscale expression by a time grayscale method. Thus, power consumption can be reduced and downsizing of an electronic device can be achieved.

8 Claims, 10 Drawing Sheets

(56) References Cited

U.S. PATENT DOCUMENTS

| | | | | |
|---|---|---|---|---|
| 2005/0168570 | A1 | 8/2005 | Kim et al. | |
| 2005/0200576 | A1 | 9/2005 | Kimura et al. | |
| 2005/0212445 | A1* | 9/2005 | Lee | 315/169.3 |
| 2005/0243079 | A1 | 11/2005 | Ozaki | |
| 2005/0259121 | A1 | 11/2005 | Miyagawa | |
| 2006/0097965 | A1* | 5/2006 | Deane et al. | 345/76 |
| 2010/0079177 | A1 | 4/2010 | Kimura | |
| 2011/0186852 | A1 | 8/2011 | Kimura et al. | |

FOREIGN PATENT DOCUMENTS

| | | | |
|---|---|---|---|
| JP | 2004-46128 | | 2/2004 |
| JP | 2004-46129 | | 2/2004 |
| JP | 2004-54200 | | 2/2004 |
| JP | 2004-341312 | | 12/2004 |
| JP | 2005-31534 | | 2/2005 |
| JP | 2005-70227 | | 3/2005 |
| KR | 10-2005-0101183 | | 10/2005 |
| WO | WO 2004/066250 | * | 8/2004 |

* cited by examiner

DISPLAY DEVICE HAVING A PLURALITY OF DRIVING TRANSISTORS AND A LIGHT EMITTING ELEMENT AND METHOD FOR DRIVING THE SAME

BACKGROUND OF THE INVENTION

1. Field of the Invention

The present invention also relates to a display device for displaying images by inputting digital video signals. The present invention further relates to an electronic device using such a display device.

2. Description of the Related Art

In recent years, a so-called self-luminous display device in which a pixel is formed using a display element such as a light emitting diode (LED) has attracted attention. As a display element used for such a self-luminous display device, an organic light emitting diode (also referred to as an OLED, an organic EL element, an electroluminescent (EL) element, or the like) has attracted attention, and has been used for an EL display and the like. Since a display element such as an OLED is of a self-luminous type, it has advantages such as higher pixel visibility, no backlight required, and higher response speed compared to a liquid crystal display. Note that the luminance of the display element is controlled by the value of current flowing therethrough.

As a method for driving such a display device to display a grayscale, there are an analog grayscale method and a digital grayscale method. The analog grayscale method includes a method to control the light emission intensity of a display element in an analog manner and a method to control the light emission time of a display element in an analog manner. As the analog grayscale method, the method to control the light emission intensity of a display element in an analog manner is often used.

However, the method to control the light emission intensity in an analog manner is easily affected by variations in characteristics of a thin film transistor (hereinafter also referred to as a TFT) of each pixel, which causes variations also in luminance of each pixel. On the other hand, in the digital grayscale method, a display element is turned on/off by control in a digital manner to express a grayscale. In the case of the digital grayscale method, the uniformity of luminance of each pixel is excellent. However, there are only two states, that is, a light emitting state and a non-light emitting state, so that only two grayscale levels can be expressed. As another technique, there are an area grayscale method in which light emission area of a pixel is weighted and selected to perform grayscale display and a time grayscale method in which light emission time is weighted and selected to perform grayscale display. In the case of the digital grayscale method, the time grayscale method, which is also suitable to obtain higher definition, is often used (Reference 1: Japanese Published Patent Application No. 2002-6808)

Higher definition can be achieved by using the time grayscale method in the digital grayscale method. However, as definition proceeds, the number of pixels is increased. Therefore, the number of pixels to which a signal is written is also increased.

In addition, the number of subframes needs to be increased to perform high level grayscale display. Therefore, the number of signal writings into a pixel is increased.

SUMMARY OF THE INVENTION

In view of the above, in the case of using a time grayscale method in accordance with the present invention, it is an object of the present invention to provide a display device in which one frame period is divided by the number of bits and the number of signal writings into a pixel can be reduced so that power consumption can be reduced. It is another object to provide a smaller electronic device that performs display by a time grayscale method.

For that object, it is a feature that circuits having the same configuration are provided for one light emitting element. Each of the circuits is provided with a switching element for selecting the light emitting element, a driving element for driving the light emitting element. For example, when each circuit is provided with a plurality of switching elements having different functions, a frame memory can be eliminated. Alternatively, even when each circuit has one switching element, a frame memory can be eliminated by providing a plurality of signal lines between the plurality of circuits. By thus reducing or eliminating a frame memory, a display device with narrower circuit frame can be obtained.

One mode of the present invention is a display device including a light emitting element; a plurality of driving transistors connected to the light emitting element in parallel; and a plurality of switching transistors provided between the light emitting element and the plurality of driving transistors, each corresponds to one of the switching transistors separately.

Another mode of the present invention is a display device including a light emitting element; a plurality of driving transistors connected to the light emitting element in parallel; a plurality of first switching transistors provided between the light emitting element and the plurality of driving transistors, each corresponds to one of the first switching transistors separately; and a plurality of second switching transistors which are connected to the plurality of driving transistors, each corresponds to one of the second switching transistors separately and connected to a plurality of signal lines, each corresponds to one of the second switching transistors separately.

In the present invention, the number of the plurality of signal lines is equal to the number of the driving transistors.

Another mode of the present invention is a display device including a light emitting element; a first driving transistor and a second driving transistor connected to the light emitting element in parallel; a first switching transistor provided between the light emitting element and the first driving transistor; and a second switching transistor provided between the light emitting element and the second driving transistor.

Another mode of the present invention is a display device including a light emitting element; a first driving transistor and a second driving transistor connected to the light emitting element in parallel; a first switching transistor provided between the light emitting element and the first driving transistors; a second switching transistor provided between the light emitting element and the second driving transistor; a third switching transistor which is connected to the first driving transistor, and connected to a signal line; and a fourth switching transistor which is connected to the second driving transistor and connected to the signal line.

Another mode of the present invention is a display device including a light emitting element; a first driving transistor and a second driving transistor connected to the light emitting element in parallel; a first switching transistor provided between the light emitting element and the first driving transistor; a second switching transistor provided between the light emitting element and the second driving transistor; a third switching transistor which is connected to the first driving transistor and connected to a first signal line; and a fourth switching transistor connected to the second driving transistor and connected to a second signal line.

Another mode of the present invention is a display device including a light emitting element; a first driving transistor, a second driving transistor, and a third driving transistor which are connected to the light emitting element in parallel; a first switching transistor which is connected to the first driving transistor and connected a first signal line; a second switching transistor which is connected to the second driving transistor and connected to a second signal line; and a third switching transistor which is connected to the third driving transistor and connected to a third signal line.

Another mode of the present invention is a display device including a light emitting element; and a first driving transistor, a second driving transistor, and a third driving transistor which are connected to the light emitting element in parallel; wherein the first driving transistor is connected to a first power supply line, the second driving transistor is connected to a second power supply line, and the third driving transistor is connected to a third power supply line.

Another mode of the present invention is a display device in which the display device includes: a light emitting element; a plurality of driving transistors which are connected in parallel and connected to the light emitting element; and a plurality of switching transistors provided between the light emitting element and the plurality of driving transistors, each corresponds to one of the switching transistors separately. Any one of the plurality of driving transistors is selected during a first writing period, so that the light emitting element emits light, and a driving transistor other than the plurality of driving transistors is selected during a second writing period after the first writing period, so that the light emitting element emits light.

Another mode of the present invention is a display device in which the display device includes: a light emitting element; a plurality of driving transistors which are connected in parallel and connected to the light emitting element; and a plurality of switching transistors provided between the light emitting element and the plurality of driving transistors, each corresponds to one of the switching transistors separately. Any one of the plurality of driving transistors is selected during a first writing period, so that the light emitting element emits light, a driving transistor other than the plurality of driving transistors is selected during a second writing period after the first writing period, so that the light emitting element emits light, and a first display period after the first writing period and a second display period after the second writing period satisfy 1:2.

The signal lines may be source signal lines. Further, the driving transistors can be used as transistors for driving the light emitting element.

A display device of which number of signal writings into a pixel by a time grayscale method can be reduced and power consumption can be reduced. Further, a frame memory included in an IC can be reduced or eliminated; thus, a smaller electronic device can be provided. Moreover, with the pixel structure of the invention, false contour can be reduced, in addition to the above advantages.

DETAILED DESCRIPTION OF THE INVENTION

Figure 1:
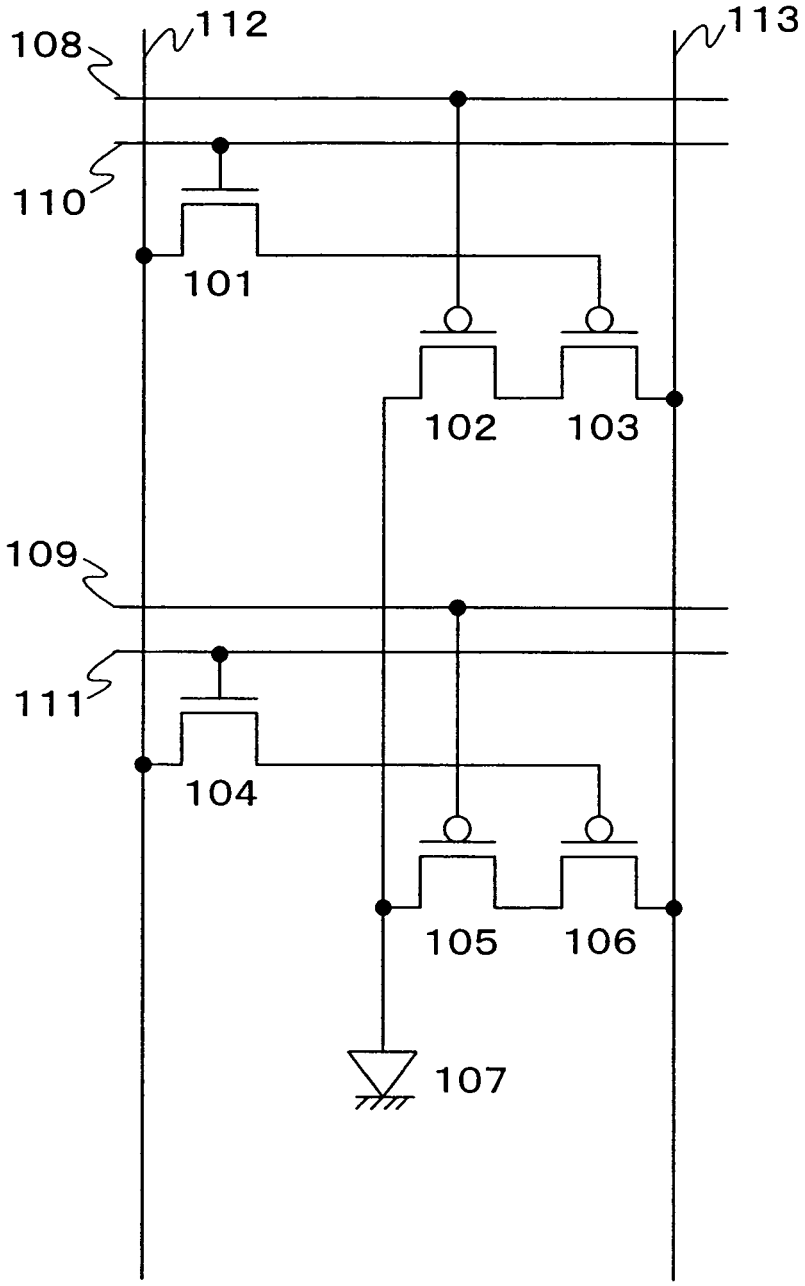
FIG. 1 illustrates a pixel structure of an embodiment mode of the present invention.

Embodiment Modes and Embodiment of the present invention will be described with reference to the drawings. Note that the present invention can be embodied with many different modes, and it is easily understood by those skilled in the art that the mode and detail can be variously modified without departing from the sprit and scope of the present invention. Therefore, the present invention is not construed as being limited to the description of Embodiment Modes and Embodiment. In all the drawings for describing Embodiment Modes and Embodiment, the same reference numerals are given to parts having similar functions or the same functions, and the description of such parts will not be repeated.

Embodiment Mode 1

A pixel structure of this embodiment mode will be described with reference to FIG. 1. Note that only one pixel is shown in the figure; however, a plurality of pixels are arranged in matrix in a column direction and a row direction in a pixel area of a display device. In this embodiment mode, a TFT is used as a switching element; however, any element having transistor functions can be used in the present invention.

A pixel shown in FIG. 1 includes switching TFTs 101, 102, 104, and 105; driving TFTs 103 and 106; a light emitting element 107, gate signal lines 108 and 109; gate scan lines 110 and 111; a source signal line 112; and a power supply line 113. The driving TFTs 103 and 106 are connected in parallel to the light emitting element 107. A part of the gate wire of the switching TFT 101, which is a gate terminal, is connected to the gate scan line 110, and a part of one of either a source wire or a drain wire (this part is referred to as a first terminal) is connected to the source signal line 112, and a part of the other of either the source wire or the drain wire (this part is referred to as a second terminal) is connected to a gate terminal of the driving TFT 103. A first terminal of the driving TFT 103 is connected to the power supply line 113, and a second terminal thereof is connected to a first terminal of the switching TFT 102. Further, a gate terminal of the switching TFT 102 is connected to the gate signal line 108, and a second terminal thereof is connected to a first electrode of the light emitting element 107. Similarly, a gate terminal of the switching TFT 104 is connected to the gate scan line 111, a first terminal thereof is connected to the source signal line 112, and a second terminal thereof is connected to a gate terminal of the driving TFT 106. A first terminal of the driving TFT 106 is connected to the power supply line 113, and a second terminal thereof is connected to a first terminal of the switching TFT 105. Further, a gate terminal of the switching TFT 105 is connected to the gate signal line 109, and a second terminal thereof is connected to a first electrode of the light emitting element 107. Note that the second terminals of the switching TFTs 102 and 105 are connected to each other, and are connected to the first electrode of the light emitting element 107.

Accordingly, a pixel of this embodiment mode has a structure in which two circuits each having two switching TFTs and a driving TFT are connected to one light emitting element. Thus, it is a feature of the invention that a plurality of circuits each having the same configuration are provided with respect to one light emitting element in one pixel. While one circuit performs writing, another circuit can retain information to be written next. Thus, a frame memory can be reduced or eliminated.

Here, a lower electric potential is applied on a second electrode of a light emitting element. Note that the lower electric potential is an electric potential which satisfies the lower electric potential<the higher electric potential based on the higher electric potential applied to the power supply line 113. As the lower electric potential, for example, GND or 0 V may be set. The potential difference between the higher electric potential and the lower electric potential is applied to the emitting element 107, thereby the light emitting element 107 is supplied with current to make the light emitting element 107 emit light. Correspondingly, each of the higher electric potential and the lower electric potential are set so that the potential difference between them is equal to or more than the forward threshold voltage of the light emitting element 107.

Further, in this embodiment mode, the switching TFTs 101 and 104 are n-channel TFTs, and the switching TFTs 102 and 105 and the driving TFTs 103 and 106 are p-channel TFTs. Note that the present invention is not limited by the polarity of the TFTs; accordingly, the switching TFTs 101 and 104 may be p-channel TFTs, and the switching TFTs 102 and 105 and the driving TFTs 103 and 106 may be n-channel TFTs. In this case, the high and low electric potentials of the source signal line and the power supply line may be reversed.

Next, the operation of the pixel of this embodiment mode will be described with reference to FIG. 6.

The gate scan lines 110 and 111 are sequentially selected, and an "L" level or "H" level signal is inputted from the source signal line 112 to the gate terminals of the driving TFTs 103 and 106 through the switching TFTs 101 and 104. When an "L" level signal is inputted to the gate terminals of the driving TFTs 103 and 106, the driving TFTs 103 and 106 are turned on. At that time, an "H" level is written into the gate signal line 108, and an "L" level is written into the gate signal line 109. When the "H" level and "L" level are inputted to the gate terminals of the switching TFTs 102 and 105 respectively, in the case where the "L" level signal is inputted to the gate terminal of the driving TFT through the switching TFT 101 or 104 and also the "L" level is inputted to the gate terminals of the switching TFTs 102 and 105, the light emitting element 107 emits light. In other words, since the "L" level is inputted to the gate terminal of the switching TFT 105 during an SF1 period, when the "L" level signal is inputted from the source signal line 112 through the switching TFT 104, the light emitting element 107 emits light.

Next, an "L" level is written into the gate signal line 108, and an "H" level is written into the gate signal line 109. When the "L" level and "H" level are inputted to the gate terminals of the switching TFTs 102 and 105, in the case where the "L" level signal is inputted to the gate terminal of the driving TFT through the switching TFT 101 or 104 and also the "L" level is inputted to the gate terminals of the switching TFTs 102 and 105, the light emitting element 107 emits light. In other words, since the "L" level is inputted to the gate terminal of the switching TFT 102 during an SF2 period, when the "L" level signal is inputted from the source signal line 112 through the switching TFT 101, the light emitting element 107 emits light.

Here, the "L" level and "H" level signals of the gate signal lines 108 and 109 are set in consideration of the electric potential of the power supply line 113 and the thresholds of the switching TFTs 102 and 105 so as to ensure that the switching TFTs 102 and 105 can be turned on or off. Further, the "L" level and "H" level signals of the source signal line 112 are set in consideration of the electric potential of the power supply line 113 and the thresholds of the driving TFTs 103 and 106 so as to ensure that the driving TFTs 103 and 106 can be turned on or off. Furthermore, the electric potentials of the gate scan lines 110 and 111 are set in consideration of the electric potential of the source signal line 112 and the thresholds of the switching TFTs 101 and 104 so as to ensure that the switching TFTs 101 and 104 can be turned on or off.

Figure 6:
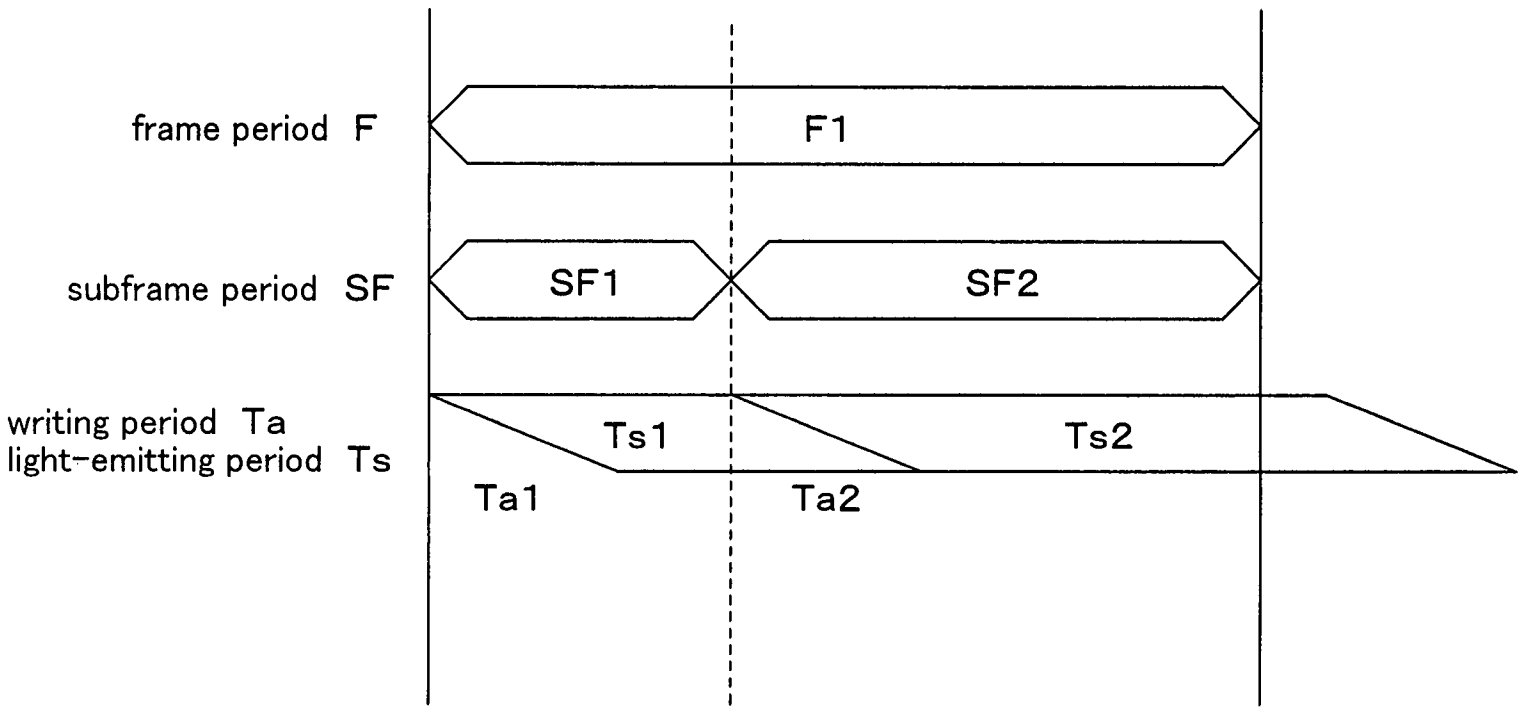
FIG. 6 is a timing chart of a driving method of the present invention.

In this embodiment mode, one frame period is divided into two subframes, and the ratios of light emission time of each subframe are differentiated as shown in FIG. 6. Grayscales can be expressed by using different total light emission times for each grayscale. Here, the ratios of the light-emitting period, namely, the lengths of the light-emitting periods satisfy Ts1:Ts2=1:2.

With such a pixel structure, the number of signal writings into a pixel can be reduced by a time grayscale method, and power consumption can be reduced. Further, a frame memory can be reduced or eliminated. Moreover, with such a pixel structure of the invention, false contour can be reduced, in addition to the above advantages.

Embodiment Mode 2

A pixel structure of this embodiment mode will be described with reference to FIG. 5. In this embodiment mode, the source signal line 112 in Embodiment Mode 1 is divided into two lines, and the gate scan lines 110 are 111 unified into a line.

Figure 5:
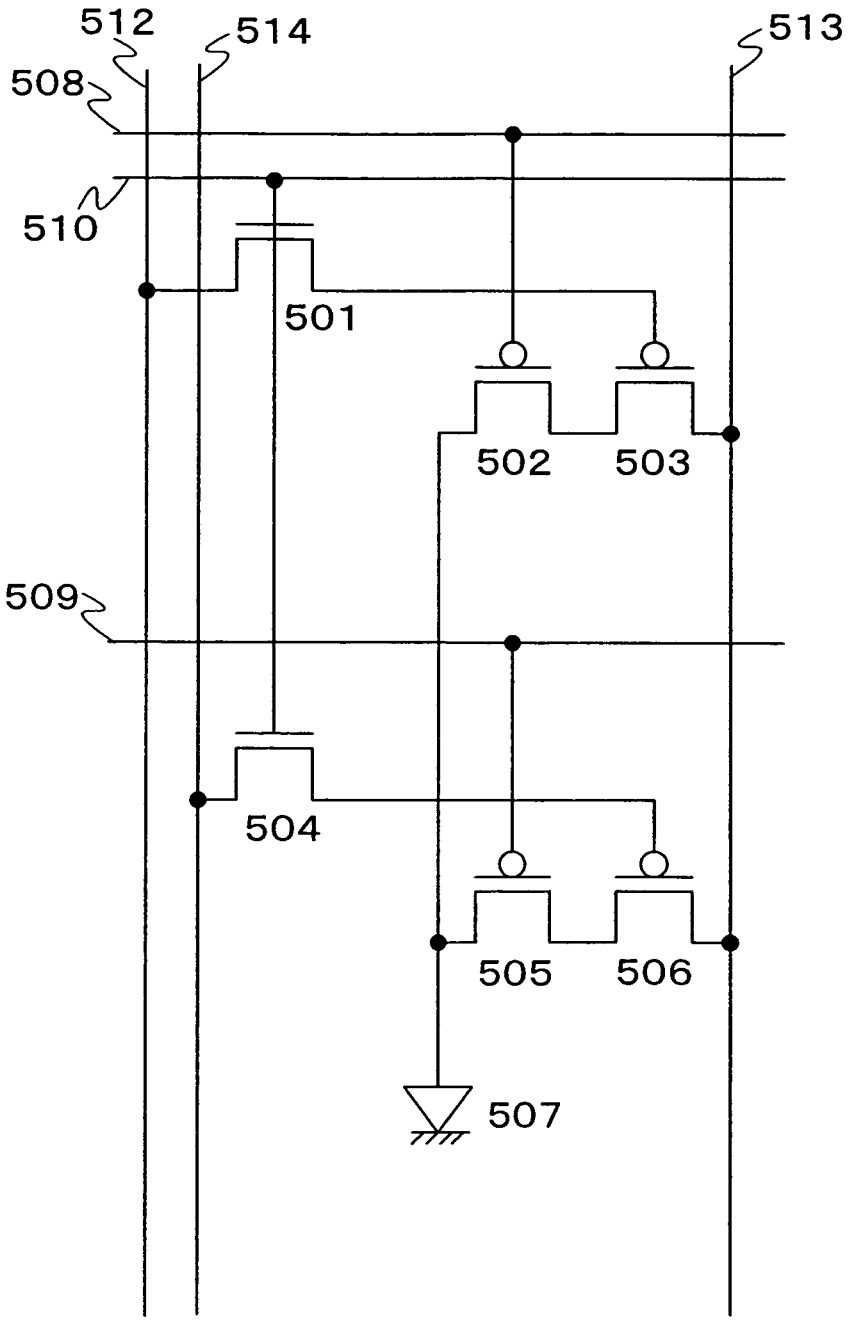
FIG. 5 illustrates a pixel structure of an embodiment mode of the present invention.

A pixel shown in FIG. 5 has source signal lines 512 and 514, and a gate scan line 510. In the pixel, a first terminal of a switching TFT 501 is connected to the source signal line 512, and a first terminal of a switching TFT 504 is connected to the source signal line 514. Both gate terminals of the switching TFTs 501 and 504 are connected to the gate scan line 510. Since other connections by switching TFTs 502 and 505, driving TFTs 503 and 506, a light emitting element 507, gate signal lines 508 and 509 and a power supply line 513 are the same as those in Embodiment Mode 1, the descriptions are omitted here.

Since the gate terminals of the switching TFTs 501 and 504 are connected to the gate scan line 510, they are selected simultaneously; however, the timing of the selection can be controlled by dividing the source signal line into two source signal lines 512 and 514.

With such a pixel structure, the number of signal writings into a pixel can be reduced by a time grayscale method, and power consumption can be reduced. Further, a frame memory can be reduced or eliminated. Moreover, with such a pixel structure of the invention, false contour can be reduced, in addition to the above advantages.

Embodiment Mode 3

A pixel structure in this embodiment mode will be described with reference to FIG. 2.

Figure 2:
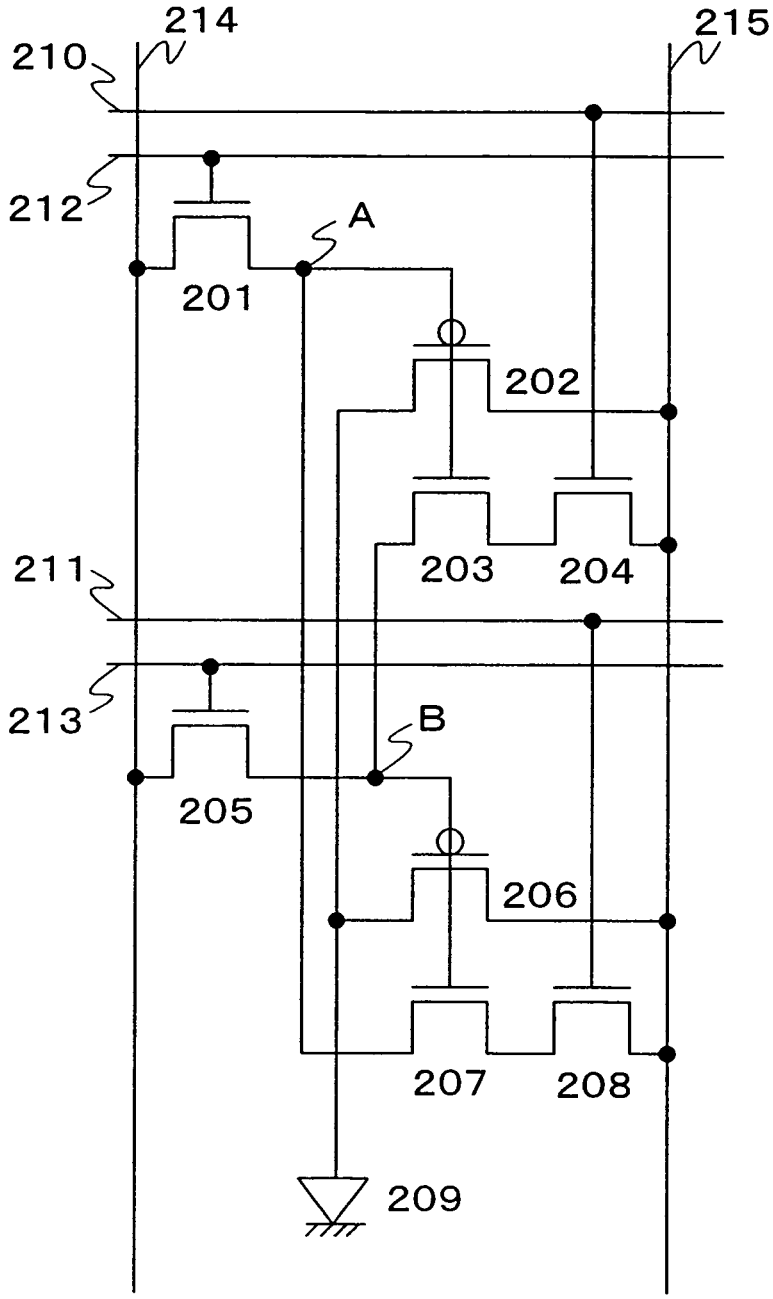
FIG. 2 illustrates a pixel structure of an embodiment mode of the present invention.

A pixel shown in FIG. 2 has switching TFTs 201, 203, 204, 205, 207, and 208; driving TFTs 202 and 206; a light emitting element 209; gate signal lines 210 and 211; gate scan lines 212 and 213; a source signal line 214; and a power supply line 215. A gate terminal of the switching TFT 201 is connected to the gate scan line 212, a first terminal (a source or drain terminal) thereof is connected to the source signal line 214, and a second terminal thereof is connected to gate terminals of the driving TFT 202 and the switching TFT 203. Further, a first terminal of the driving TFT 202 is connected to the power supply line 215, and a second terminal thereof is connected to a first electrode of the light emitting element 209. A gate terminal of the switching TFT 204 is connected to the gate signal line 210, a first terminal thereof is connected to the power supply line 215, and a second terminal thereof is connected to a first terminal of the switching TFT 203. Similarly, a gate terminal of the switching TFT 205 is connected to the gate scan line 213, a first terminal thereof is connected to the source signal line 214, and a second terminal thereof is connected to gate terminals of the driving TFT 206 and the switching TFT 207. Further, a first terminal of the driving TFT 206 is connected to the power supply line 215, and a second terminal thereof is connected to a first electrode of the light emitting element 209. A gate terminal of the switching TFT 208 is connected to the gate signal line 211, a first terminal thereof is connected to the power supply line 215, and a second terminal thereof is connected to a first terminal of the switching TFT 207. Further, a second terminal of the switching TFT 203 is connected to the second terminal of the switching TFT 205, and a second terminal of the switching TFT 207 is connected to the second terminal of the switching TFT 201. Note that the second terminals of the driving TFTs 202 and 206 are connected to each other and are connected to the first electrode of the light emitting element 209.

A lower electric potential is applied to a second electrode of the light emitting element. Note that the lower electric potential is an electric potential which satisfies the lower electric potential<the higher electric potential based on the higher electric potential applied to the power supply line 215. As the lower electric potential, for example, GND or 0 V may be set. The potential difference between the higher electric potential and the lower electric potential is applied to the light emitting element 209, thereby the light emitting element 209 is supplied with current to make the light emitting element 209 emit light. Correspondingly, each of the higher electric potential and the lower electric potential are set so that the potential difference between them is equal to or more than the forward voltage threshold of the light emitting element 209.

In this embodiment mode, the switching TFTs 201, 203, 204, 205, 207, and 208 are n-channel TFTs, and the driving TFTs 202 and 206 are p-channel TFTs.

Next, the operation of the pixel of this embodiment mode will be described.

In the case where an "L" level is written into the gate signal lines 210 and 211, the switching TFTs 204 and 208 are turned off. The gate scan lines 212 and 213 are selected sequentially, and an "L" level or "H" level signal is inputted from the source signal line 214 to the gate terminals of the driving TFTs 202 and 206 and the switching TFTs 203 and 207 through the switching TFTs 201 and 205. When an "L" level signal is inputted from the source signal line 214 through the switching TFT 201 and an "H" level signal is inputted from the source signal line through the switching TFT 205, the driving TFT 202 into which the "L" level signal is inputted is turned on, and the light emitting element 209 emits light. Then, when the "H" level is written into the gate signal line 211, switching TFTs 208 and 207 are turned on, and the electric potential of A is changed into the "H" level. Then, the driving TFT 202 which has been on is turned off, so that the light emission of the light emitting element 209 finishes. When the "L" level is written into the gate signal lines 210 and 211, the "H" level signal is inputted from the source signal line 214 through the switching TFT 201, and the "L" level signal is inputted through the switching TFT 205, the driving TFT 206 into which the "L" level signal is inputted is turned on, so that the light emitting element 209 emits light. Then, the "H" level is written into the gate signal line 210, the switching TFTs 204 and 203 are turned on, and the electric potential of B changes from the "L" level to the "H" level. Thereupon, the driving TFT 206 which has been on is turned off, so that the light emission of the light emitting element 209 finishes. In the case where the "L" level is written into the gate signal lines 210 and 211, and the "L" level signal is inputted from the source signal line 214 through the switching TFTs 201 and 205, the driving TFTs 202 and 206 into which the "L" level signal is inputted are turned on, so that the light emitting element 209 emits light. Further, in the case where the "H" level signal is inputted from the source signal line 214 through the switching TFTs 201 and 205, the light emitting element 209 does not emit light.

Here, the "L" level and "H" level signals of the gate signal lines 210 and 211 are set in consideration of the electric potential of the power supply line 215 and the thresholds of the switching TFTs 204 and 208 so as to ensure that the switching TFTs 204 and 208 can be turned on or off. Further, the "L" level and "H" level signals of the source signal line 214 are set in consideration of the electric potential of the power supply line 215 and the thresholds of the driving TFTs 202 and 206 so as to ensure that the driving TFTs 202 and 206, and the switching TFTs 203 and 207 can be turned on or off. Furthermore, the electric potentials of the gate scan lines 212 and 213 are set in consideration of the electric potential of the source signal line 214 and the thresholds of the switching TFTs 201 and 205 so as to ensure that the switching TFTs 201 and 205 can be turned on or off.

In this embodiment mode, since the number of the TFTs is increased, the circuit is more complicated than Embodiment Mode 1. However, since a light-emitting period is not weighted, false contour can be reduced.

With such a pixel structure, the number of signal writings into a pixel can be reduced by a time grayscale method, and power consumption can be reduced. Further, a frame memory can be reduced or eliminated. Moreover, with such a pixel structure of the invention, false contour can be reduced, in addition to the above advantages.

Embodiment Mode 4

A pixel structure of this embodiment mode will be described with reference to FIG. 3.

Figure 3:
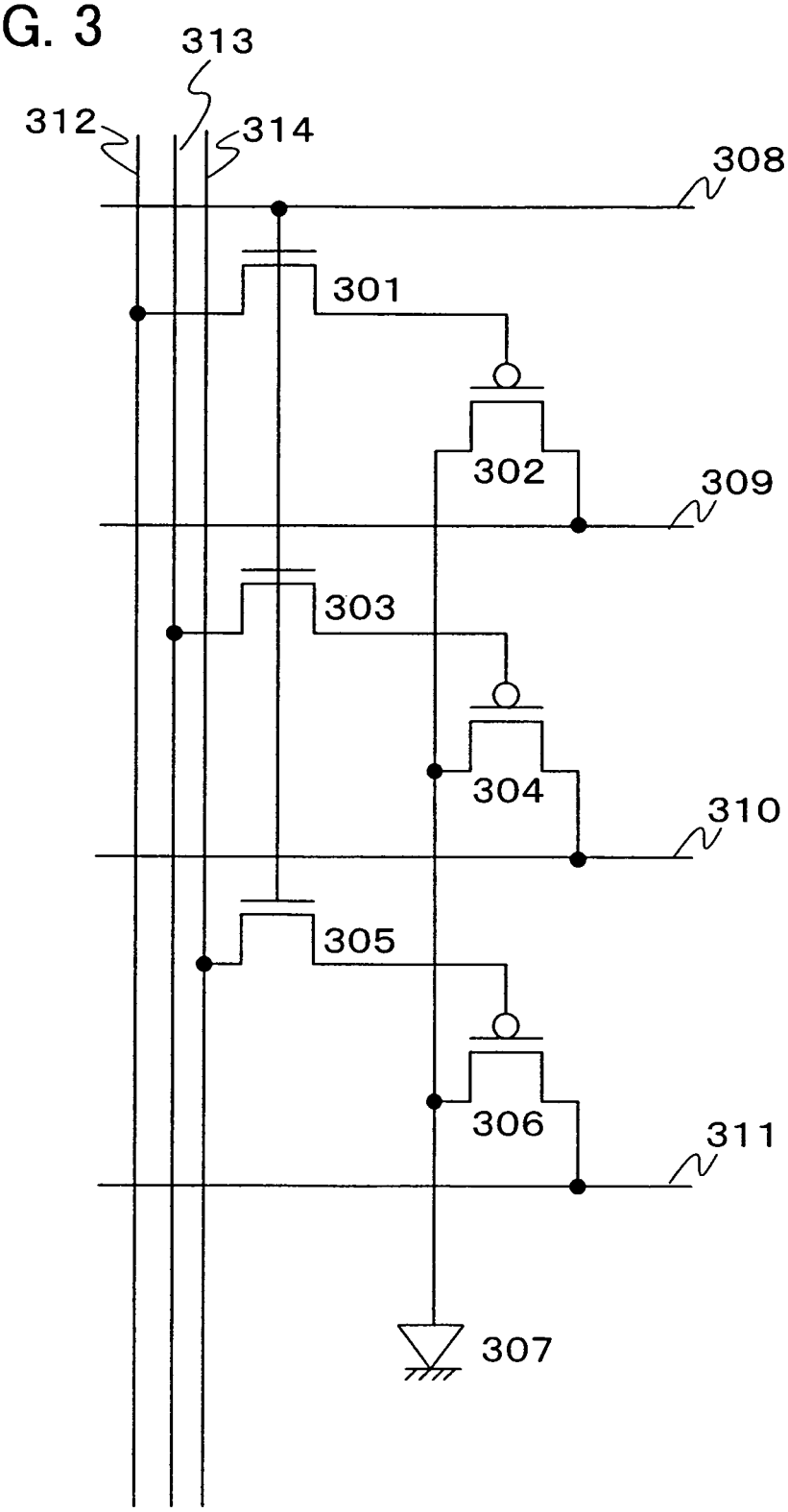
FIG. 3 illustrates a pixel structure of an embodiment mode of the present invention.

A pixel shown in FIG. 3 has switching TFTs 301, 303, and 305, driving TFTs 302, 304, and 306, a light emitting element 307, a gate scan line 308, power supply lines 309, 310, and 311, and source signal lines 312, 313, and 314. The driving TFTs 302, 304, 306 are connected in parallel to the light emitting element 307. A gate terminal of the switching TFT 301 is connected to the gate scan line 308, a first terminal thereof is connected to the source signal line 312, and a second terminal thereof is connected to a gate terminal of the driving TFT 302. Further, a first terminal of the driving TFT 302 is connected to the power supply line 309, and a second terminal thereof is connected to a first electrode of the light emitting element 307. Similarly, a gate terminal of the switching TFT 303 is connected to the gate scan line 308, a first terminal thereof is connected to the source signal line 313, and a second terminal thereof is connected to a gate terminal of the driving TFT 304. Further, a first terminal of the driving TFT 304 is connected to the power supply line 310, and a second terminal thereof is connected to a first electrode of the light emitting element 307. Further, similarly, a gate terminal of the switching TFT 305 is connected to the gate scan line 308, a first terminal thereof is connected to the source signal line 314, and a second terminal thereof is connected to a gate terminal of the driving TFT 306. A first terminal of the driving TFT 306 is connected to the power supply line 311, and a second terminal thereof is connected to the first electrode of the light emitting element. Note that the second terminals of the driving TFTs 302, 304, and 306 are connected to each other and are connected to the first electrode of the light emitting element 307.

A lower electric potential is applied to a second electrode of the light emitting element. Note that the lower electric potential is an electric potential which satisfies the lower electric potential<the higher electric potential based on the higher electric potential applied to the power supply lines 309, 310, and 311. As the lower electric potential, for example, GND or 0 V may be set. The potential difference between the higher electric potential and the lower electric potential is applied to the light emitting element 307, thereby the light emitting element 307 is supplied with current to make the light emitting element 307 emit light. Correspondingly, each of the higher electric potential and the lower electric potential are set so that the potential difference between them is equal to or more than the forward voltage threshold of the light emitting element 307.

In this embodiment mode, the switching TFTs 301, 303, and 305 are n-channel TFTs, and the driving TFTs 302, 304, and 306 are p-channel TFTs.

Next, the operation of the pixel of this embodiment mode will be described.

The switching TFTs 301, 303, and 305 are selected at the same time by the gate scan line 308, and "L" level or "H" level signals are each inputted from the source signal lines 312, 313, and 314 to gate terminals of the driving TFT 302, 304, 306 through the switching TFTs 301, 303, and 305. At this time, even if the switching TFTs 301, 303, and 305 are selected at the same time, because of the three source signal lines, the light emission of the light emitting element 307 can be controlled with desired timings. In the case where an "H" level signal is inputted to the gate terminals of the driving TFTs 302, 304, and 306, the light emitting element 307 does not emit light. In the case where an "L" level signal is inputted to one of the gate terminals of the driving TFTs 302, 304, or 306, the light emitting element 307 emits light. The gate terminals of the three switching TFTs share the gate scan line 308, and are connected to the separate three source signal lines 312, 313, and 314.

The power supply lines 309, 310, and 311 have different electric potentials. Accordingly, an "L" level signal is not to be inputted to more than one of the gate terminals of the driving TFTs 302, 304, and 306. Thus, in this embodiment mode, four grayscales can be expressed by 3 bits without storing signals in grayscale expression by a time grayscale method.

Here, the "L" level and "H" level signals of the source signal lines 312, 313, and 314 are each set in consideration of the electric potentials of the power supply lines 309, 310, and 311 and the thresholds of the driving TFTs 302, 304, and 306 so as to ensure that the driving TFTs 302, 304, and 306 can be turned on or off. Further, the electric potential of the gate scan line 308 is set in consideration of the electric potential of the source signal line 312 and thresholds of the switching TFTs 301, 303, and 305 so as to ensure that the switching TFTs 301, 303, and 305 can be turned on or off.

With such a pixel structure, the number of signal writings into a pixel can be reduced by a time grayscale method, and power consumption can be reduced. Further, a frame memory can be reduced or eliminated. Moreover, with such a pixel structure of the invention, false contour can be reduced, in addition to the above advantages.

Embodiment Mode 5

A pixel structure of this embodiment mode will be described with reference to FIG. 4.

Figure 4:
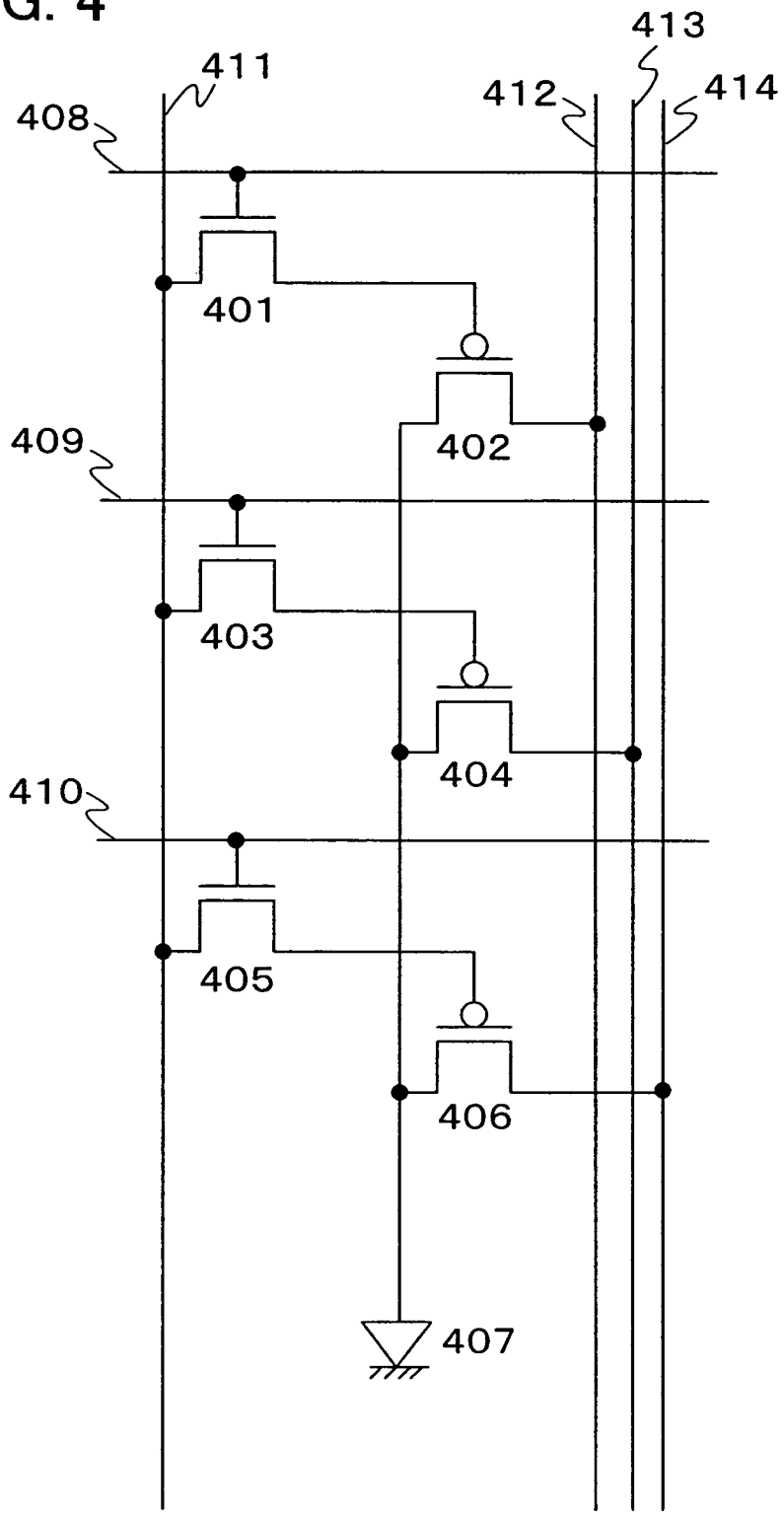
FIG. 4 illustrates a pixel structure of an embodiment mode of the present invention.

A pixel shown in FIG. 4 has switching TFTs 401, 403, and 405, driving TFTs 402, 404, and 406, a light emitting element 407, gate scan lines 408, 409, and 410, a source signal line 411, and power supply lines 412, 413, and 414. A gate terminal of the switching TFT 401 is connected to the gate scan line 408, a first terminal thereof is connected to the source signal line 411, and a second terminal thereof is connected to a gate terminal of the driving TFT 402. Further, a first terminal of the driving TFT 402 is connected to the power supply line 412, and a second terminal thereof is connected to a first electrode of the light emitting element 407. Similarly, a gate terminal of the switching TFT 403 is connected to the gate scan line 409, a first terminal thereof is connected to the source signal line 411, and a second terminal thereof is connected to a gate terminal of the driving TFT 404. A first terminal of the driving TFT 404 is connected to the power supply line 413, and a second terminal thereof is connected to a first electrode of the light emitting element 407. Further, similarly, a gate terminal of the switching TFT 405 is connected to the gate scan line 410, a first terminal thereof is connected to the source signal line 411, and a second terminal thereof is connected to a gate terminal of the driving TFT 406. A first terminal of the driving TFT 406 is connected to the power supply line 414, and a second terminal thereof is connected to the first electrode of the light emitting element 407. Note that the second terminals of the driving TFTs 402, 404, and 406 are connected to each other and are connected to the first electrode of the light emitting element 407.

A lower electric potential is applied to a second electrode of the light emitting element. Note that the lower electric potential is an electric potential which satisfies the lower electric potential<the higher electric potential based on the higher electric potential applied to the power supply lines 412, 413, and 414. As the lower electric potential, for example, GND or 0 V may be set. The potential difference between the higher electric potential and the lower electric potential is applied to the emitting element 407, thereby the light emitting element 407 is supplied with current to make the light emitting element 407 emit light. Correspondingly, each of the higher electric potential and the lower electric potential are set so that the potential difference between them is equal to or more than the forward threshold voltage of the light emitting element 407.

In this embodiment mode, the switching TFTs 401, 403, and 405 are n-channel TFTs, and the driving TFTs 402, 404, and 406 are p-channel TFTs.

Next, the operation of the pixel of this embodiment mode will be described.

The gate scan lines 408, 409, and 410 are sequentially selected, and an "L" level or "H" level signal is inputted from the source signal line 411 to the gate terminals of the driving TFTs 402, 404, and 406 through the switching TFTs 401, 403, and 405. When an "H" level signal is inputted to the gate terminals of the driving TFTs 402, 404, and 406, the light emitting element 407 does not emit light. When an "L" level is inputted to one of the gate terminals of the driving TFTs 402, 404, or 406, the light emitting element 407 emits light.

The power supply lines 412, 413, and 414 have different electric potentials. Accordingly, an "L" level signal is not to be inputted to more than one of the gate terminals of the driving TFTs 402, 404, and 406. Thus, in this embodiment mode, four grayscales can be expressed by 3 bits without storing signals in gray scale expression by accordance with a time grayscale method.

Here, the "L" level and "H" level signals of the source signal line 411 are each set in consideration of the electric potentials of the power supply lines 412, 413, and 414 and the thresholds of the driving TFTs 402, 404, and 406 so as to ensure that the driving TFTs 402, 404, and 406 can be turned on or off. Further, the electric potentials of the gate scan lines 408, 409, and 410 are set in consideration of the electric potential of the source signal line 411 and the thresholds of the switching TFTs 401, 403, and 405 so as to ensure that the switching TFTs 401, 403, and 405 can be turned on or off.

With such a pixel structure, the number of signal writings into a pixel can be reduced by a time grayscale method, and power consumption can be reduced. Further, a frame memory can be reduced or eliminated. Moreover, with such a pixel structure of the invention, false contour can be reduced, in addition to the above advantages.

Embodiment Mode 6

Figure 10A:
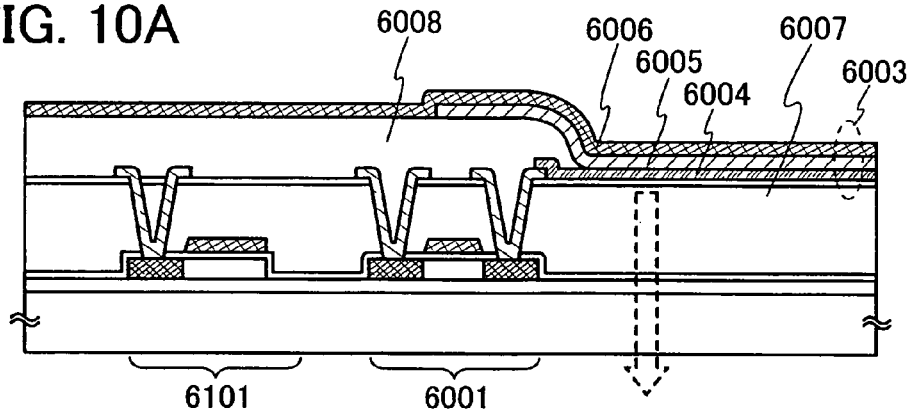
FIGS. 10A to 10C are cross-sectional views illustrating pixel structures of the present invention.
Figure 10B:
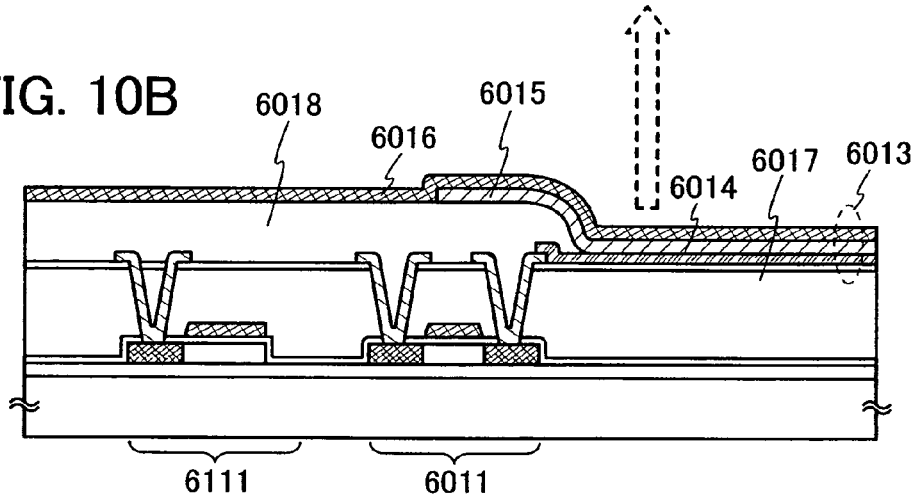
Figure 10C:
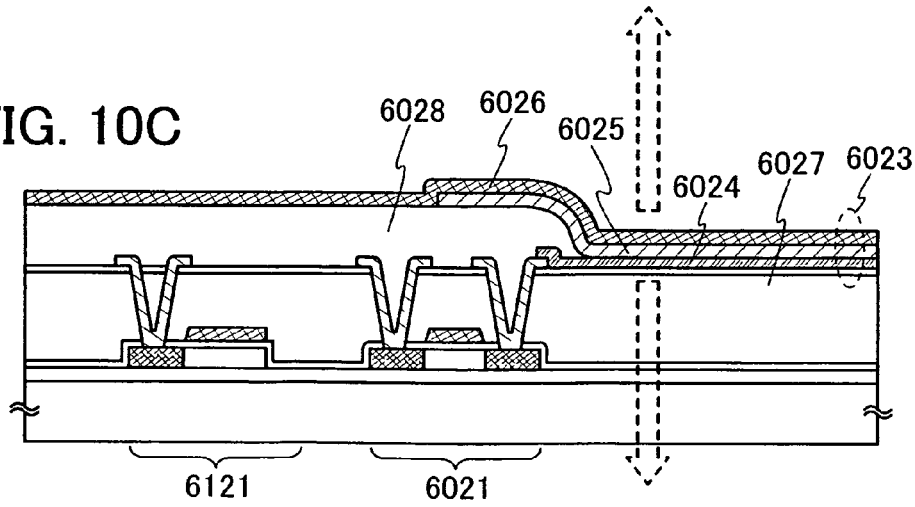

In this embodiment mode, a cross-sectional structure of a pixel including a light emitting element will be described. Description will be given on a cross-sectional structure of a pixel of the case where a driving TFT which controls current supplied to the light emitting element is a P-type TFT as described above with reference to FIGS. 10A to 10C. It is to be noted that in the invention, one of an anode and a cathode included in the light emitting element, which has an electrical potential controlled by a transistor, is a first electrode while the other is a second electrode. In FIGS. 10A to 10C, the first electrode is an anode and the second electrode is a cathode, however, the first electrode may be a cathode and the second electrode may be an anode.

FIG. 10A is a cross-sectional view of a pixel of the case where a first driving TFT 6001 and a second driving TFT 6101 are P-type transistors and light emitted from a light emitting element 6003 is extracted from a first electrode 6004 side. In FIG. 10A, the first electrode 6004 of the light emitting element 6003 is electrically connected to the first driving TFT 6001 and the second driving TFT 6101. Incidentally, the second driving TFT 6101 and the first electrode 6004 are not shown in FIG. 10A.

The first driving TFT 6001 and the second driving TFT 6101 are covered with an interlayer insulating film 6007 over which a partition 6008 having an opening is formed. A part of the first electrode 6004 is exposed in the opening of the partition 6008, and the first electrode 6004, an electroluminescent layer 6005, and a second electrode 6006 are stacked in order in the opening.

A structure in which an anode, a light-emitting layer, and a cathode are stacked in order is basically used for the electroluminescent layer 6005; alternatively, a structure in which an anode, a hole injection layer, a light-emitting layer, an electron injection layer, and a cathode are stacked in order; a structure in which an anode, a hole injection layer, a hole transporting layer, a light-emitting layer, an electron transporting layer, an electron injection layer, and a cathode are stacked in order; or the like can be used.

The electroluminescent layer is not limited to a layer having a layered structure in which the hole injection layer, the hole transporting layer, the light-emitting layer, the electron transporting layer, the electron injection layer, and the like which are clearly distinguished. Accordingly, the electroluminescent layer may have a structure including a layer in which respective materials of forming the hole injection layer, the hole transporting layer, the light-emitting layer, the electron transporting layer, the electron injection layer, or the like are mixed.

The electroluminescent layer may be either an element which uses light emitted at the time of a transition from a singlet excited state to a base state (fluorescence), and an element which uses light emitted at the time of a transition from a triplet excited state to a ground state (phosphorescence).

Further, the electroluminescent layer may have a layer in which an inorganic material is mixed.

The interlayer insulating film 6007 can be formed using an organic resin film, an inorganic insulating film, or an insulating film including a Si—O—Si bond, which is formed using a siloxane-based material as a starting material (hereinafter referred to as a siloxane-based insulating film). Note that siloxane has a skeleton formed by a silicon (Si)-oxygen (O) bond. An organic group containing at least hydrogen (such as an alkyl group or aromatic hydrocarbon) is used as a substituent. Further, a fluoro group may be used as a substituent. In addition, an organic group containing at least hydrogen and a fluoro group may be used as a substituent. A material referred to as a low dielectric constant material (low-k material) may be used for the interlayer insulating film 6007.

The partition 6008 may be formed with an organic resin film, an inorganic insulating film, or a siloxane-based insulating film. The organic resin film may be formed of acryl, polyimide, polyamide, or the like, and the inorganic insulating film may be formed of silicon oxide, silicon nitride oxide, or the like. In particular, when the partition 6008 is formed with a photosensitive organic resin film and an opening is formed over the first electrode 6004 so that the side wall of the opening is sloped to have a continuous curvature, the first electrode 6004 can be prevented from connecting to the second electrode 6006.

The first electrode 6004 is formed using a light transmitting material or a material having such a thickness as to transmit light, which is also suitable for an anode. As a specific material, in addition to aluminum (Al) or a light-transmitting material such as indium tin oxide (ITO), indium tin oxide containing silicon oxide (also referred to as ITSO), or indium oxide containing zinc oxide, a metal material of gold (Au), platinum (Pt), nickel (Ni), tungsten (W), chromium (Cr), molybdenum (Mo), iron (Fe), cobalt (Co), copper (Cu), palladium (Pd), or the like can be used. The first electrode can have a single-layer structure of one of those materials or a layered structure of them. Note that when a material other than a light transmitting material is used, the first electrode 6004 is formed to have such a thickness as to transmit light (preferably, approximately 5 nm to 30 nm).

The second electrode 6006 can be formed using a light reflecting material or shielding material or a material having such a thickness as to reflect or shield light, and can be formed using metal, an alloy, a conductive compound, a mixture thereof, or the like which has a low work function. Specifically, in addition to a light-transmitting material such as indium tin oxide (ITO), indium tin oxide containing silicon oxide (ITSO), or indium oxide containing zinc oxide, a metal material of gold (Au), platinum (Pt), nickel (Ni), tungsten (W), chromium (Cr), molybdenum (Mo), iron (Fe), cobalt (Co), copper (Cu), palladium (Pd), aluminum (Al), magnesium (Mg), silver (Ag) or the like. The second electrode 3102 can have a single-layer structure of one of those materials or a layered structure of them.

In the case of the pixel shown in FIG. 10A, light emitted from the light emitting element 6003 may be extracted from the first electrode 6004 side as shown by an open arrow.

FIG. 10B is a cross-sectional view of a pixel of the case where a first driving TFT 6011 and a second driving TFT 6111 are P-channel transistors and light emitted from a light emitting element 6013 is extracted from a second electrode 6016 side. FIG. 10B shows a structure in which a first electrode 6014 of the light emitting element 6013 is electrically connected to the first driving TFT 6011 and the second driving TFT 6111. The first driving TFT 6011 and the second driving TFT 6111 are covered with an interlayer insulating film 6017 over which a partition 6018 having an opening is formed. Over the first electrode 6014, an electroluminescent layer 6015 and the second electrode 6016 are stacked in order.

The first electrode 6014 is formed using a light reflecting or shielding material, which is also suitable for an anode. It can be formed using a similar material to that of the second electrode shown in FIG. 10A.

The second electrode 6016 can be formed using a light transmitting material, which is a metal, an alloy, or a conductive compound, which has a low work function; a mixture thereof; or the like. It can be formed using a similar material to that of the first electrode shown in FIG. 10A.

The electroluminescent layer 6015 can be formed in a similar manner to the electroluminescent layer 6005 shown in FIG. 10A.

In the case of the pixel shown in FIG. 10B, light emitted from the light emitting element 6013 can be extracted from the second electrode 6016 side as shown by an open arrow.

FIG. 10C is a cross-sectional view of a pixel in the case where a first driving TFT 6021 and a second driving TFT 6121 are P-channel transistors, and light emitted from a light emitting element 6023 is extracted from both sides of a first electrode 6024 and a second electrode 6026. FIG. 10C illustrates the structure in which the first electrode 6024 of the light emitting element 6023 is electrically connected to the first driving TFT 6021 and the second driving TFT 6121. The first driving TFT 6021 and the second driving TFT 6121 are covered with an interlayer insulating film 6027 over which a partition 6028 having an opening is formed. Over the first electrode 6024, an electroluminescent layer 6025 and a second electrode 6026 are stacked in order.

The first electrode 6024 may be formed in a similar manner to the first electrode 6004 shown in FIG. 10A. The second electrode 6026 may be formed in a similar manner to the second electrode 6016 shown in FIG. 10B. In addition, the electroluminescent layer 6025 may be formed in a similar manner to the electroluminescent layer 6005 shown in FIG. 10A.

In the case of the pixel shown in FIG. 10C, light emitted from the light emitting element 6023 can be extracted from both the first electrode 6024 side and the second electrode 6026 side as shown by open arrows.

In such a pixel structure, substrate, a polarizing plate, or a circularly polarizing plate may be provided on each of a substrate and another substrate opposite to the substrate (hereinafter referred to as a counter substrate). With such a structure, contrast can be increased. In particular, when light is extracted from the first electrode 6024 side and the second electrode 6026 side shown in FIG. 10C, it is advantageous to increase contrast by providing a polarizing plate or a circularly polarizing plate.

When a driving method described above is adopted with such a pixel structure, the number of signal writings into a pixel can be reduced by a time grayscale method, and power consumption can be reduced. Further, a frame memory can be reduced or eliminated. Moreover, with such a pixel structure of the invention, false contour can be reduced, in addition to the above advantages.

This embodiment mode can be freely combined with any of the above embodiment modes.

Embodiment Mode 7

Figure 7:
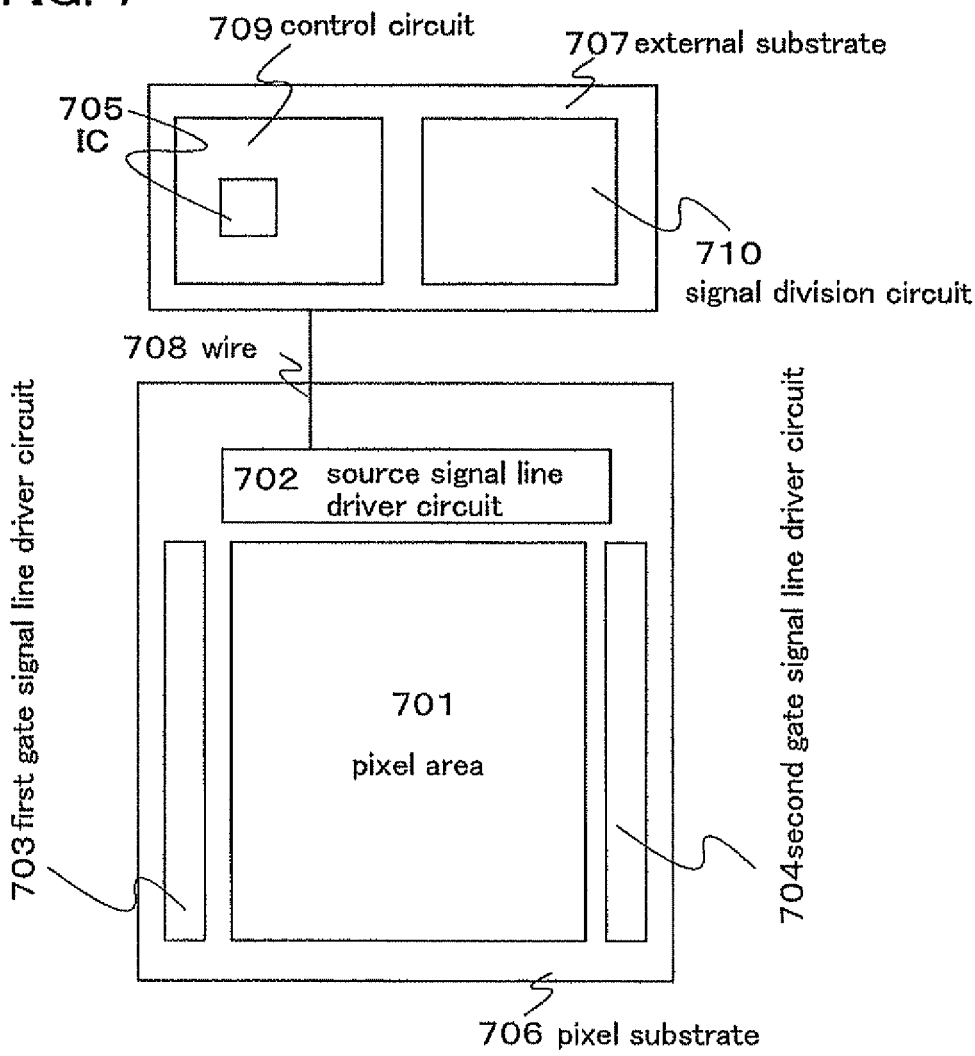
FIG. 7 is a block diagram illustrating a structure of a conventional display device.

In this embodiment mode, a structure of a display device will be described with reference to FIG. 7.

In the display device, a pixel area 701 is formed over a substrate (referred to as a pixel substrate) 706 having an insulating surface, a source signal line driver circuit 702, a first gate signal line driver circuit 703, and a second gate signal line driver circuit 704 are provided so as to surround the pixel area 701. The pixel area 701 has a plurality of pixels as described above.

An external substrate 707 is provided to connect to the source signal line driver circuit 702 through a wire (also referred to as a cable) 708. The external substrate 707 includes a control circuit 709 and a signal division circuit 710. The control circuit 709 is provided with an IC 705. A frame memory provided from the IC 705 can be reduced or eliminated in accordance with the present invention.

Embodiment Mode 8

Examples of electronic devices each provided with light emitting devices of the invention can be given as follows: a television device (also simply referred to as a television or a television receiver), a digital camera, a digital video camera, a cellular phone device (also simply referred to as a cellular phone or a cell-phone), a portable information terminal such as a PDA, a portable game machine, a computer monitor, a computer, an audio reproducing device such as a car audio, an image reproducing device including a recording medium such as a home-use game machine, and the like. Practical examples thereof are hereinafter explained with reference to FIGS. 9A to 9F.

Figure 9A:
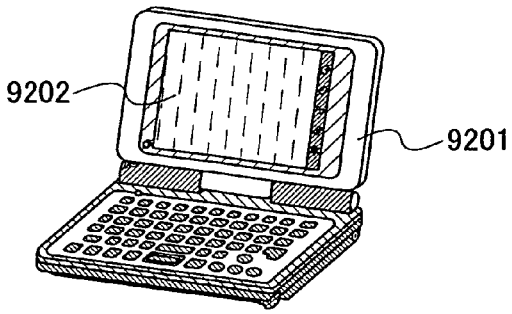
FIGS. 9A to 9F illustrate electronic devices using a display device of the present invention.

A portable information terminal shown in FIG. 9A includes a main body 9201, a display portion 9202, and the like. The light emitting device of the invention can be applied to the display portion 9202. Thus, the number of signal writings can be reduced, power consumption can be reduced, and a frame memory can be reduced or eliminated, so that a portable information terminal with a narrower circuit frame can be provided.

Figure 9B:
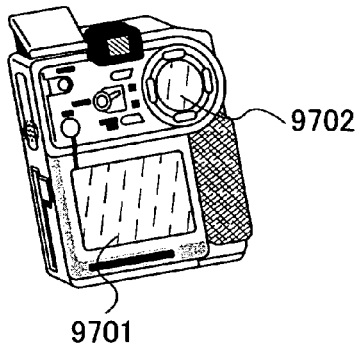

A digital video camera shown in FIG. 9B includes a display portion 9701, a display portion 9702, and the like. The light emitting device of the invention can be applied to the display portion 9701 and the display portion 9702. Thus, the number of signal writings can be reduced, power consumption can be reduced, and a frame memory can be reduced or eliminated, so that a digital video camera with a narrower circuit frame can be provided.

Figure 9C:
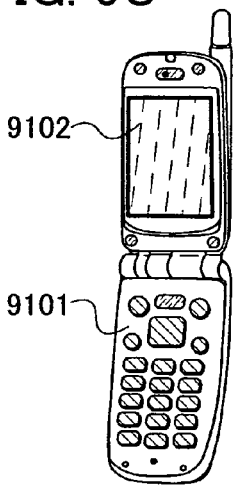

A cellular phone shown in FIG. 9C includes a main body 9101, a display portion 9102, and the like. The light emitting device of the invention can be applied to the display portion 9102. Thus, the number of signal writings can be reduced, power consumption can be reduced, and a frame memory can be reduced or eliminated, so that a cellular phone with a narrower circuit frame can be provided.

Figure 9D:
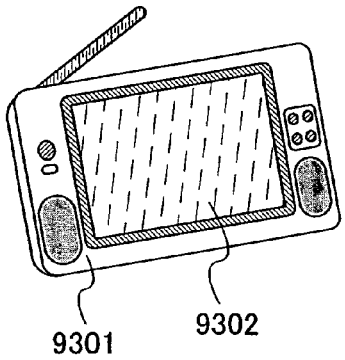

A portable television device shown in FIG. 9D includes a main body 9301, a display portion 9302, and the like. The light emitting device of the invention can be applied to the display portion 9302. Thus, the number of signal writings can be reduced, power consumption can be reduced, and a frame memory can be reduced or eliminated, so that a portable television device with a narrower circuit frame can be provided. In addition, the light emitting device of the invention can be applied to a wide range of television devices including a small television device mounted on a portable terminal such as a cellular phone, a medium television device which is portable, and a large (for example, 40-inch or larger) television device.

Figure 9E:
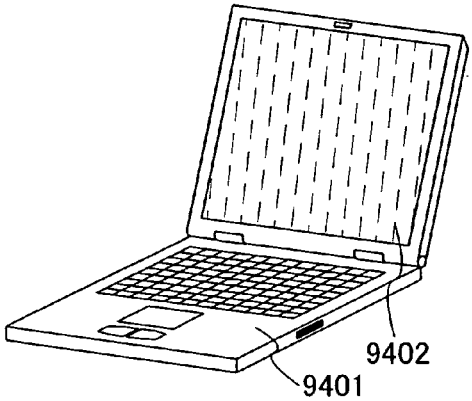

A portable computer shown in FIG. 9E includes a main body 9401, a display portion 9402, and the like. The light emitting device of the invention can be applied to the display portion 9402. Thus, the number of signal writings can be reduced, power consumption can be reduced, and a frame memory can be reduced or eliminated, so that a portable computer with a narrower circuit frame can be provided.

Figure 9F:
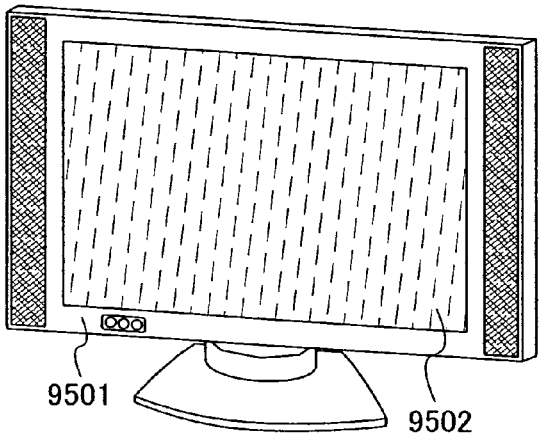

A television device shown in FIG. 9F includes a main body 9501, a display portion 9502, and the like. The light emitting device of the invention can be applied to the display portion 9502. Thus, the number of signal writings can be reduced, power consumption can be reduced, and a frame memory can be reduced or eliminated, so that a television device with a narrower circuit frame can be provided.

Thus, using the light emitting device of the invention, the number of signal writings can be reduced, power consumption can be reduced, and a frame memory can be reduced or eliminated, so that a television device with a narrower circuit frame can be provided.

Embodiment 1

Figure 8:
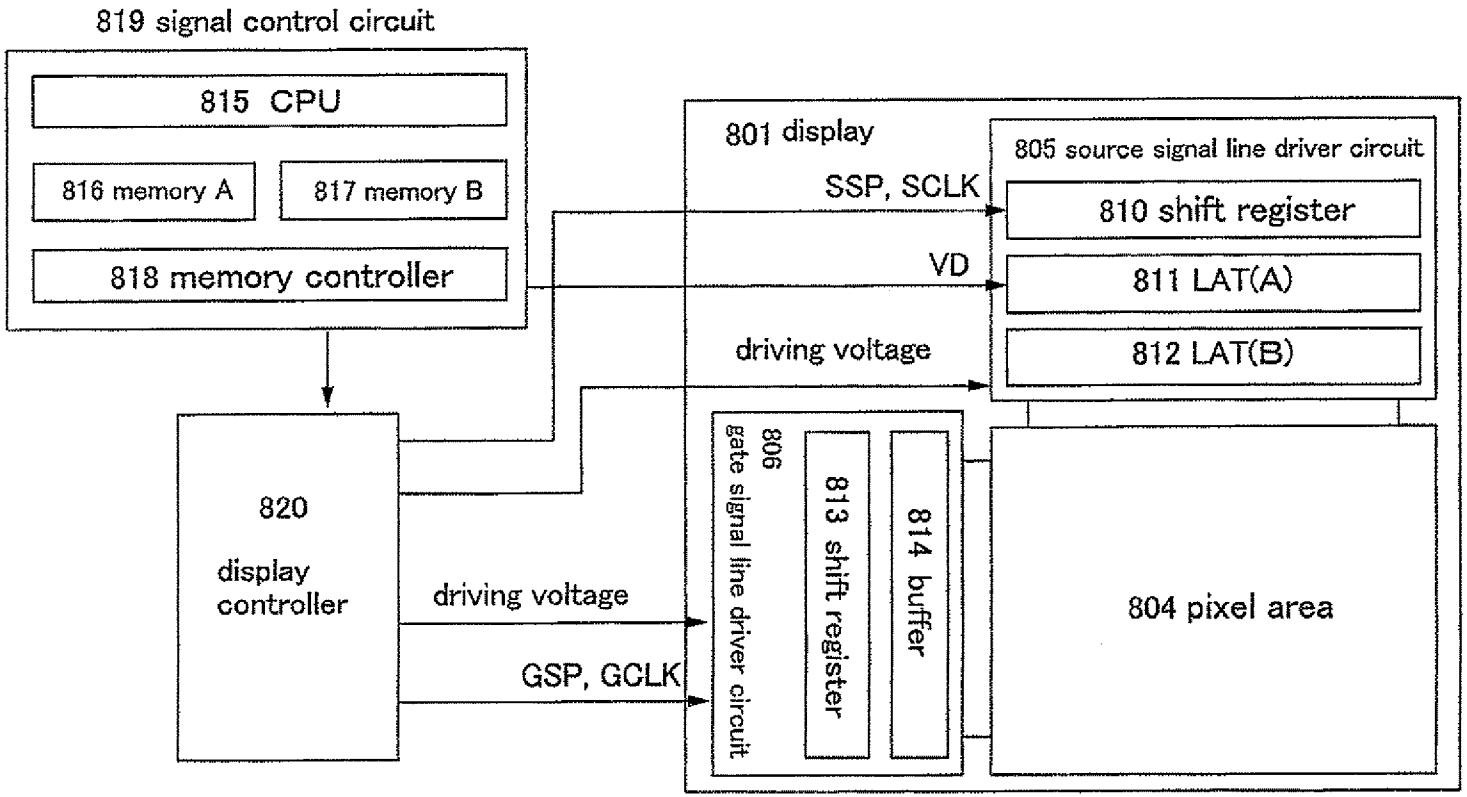
FIG. 8 is a block diagram illustrating a structure of a display device of the present invention.

A circuit in which a signal for conducting a time grayscale driving method is inputted to a source signal line driver circuit 805 and a gate signal line driver circuit 806 will be described with reference to FIG. 8.

In this specification, an image signal to be inputted to the display device is called a digital video signal. Here, an example of a display device for displaying an image by inputting a 4-bit digital video signal. Note that the invention is not limited to 4 bits.

A digital video signal is read by a signal control circuit 819, and a digital image signal (VD) is outputted to a display 801.

Note also that in this specification, a digital video signal converted in the signal control circuit 819 into a signal to be inputted into the display 801 is called a digital image signal.

A signal and a driving voltage for driving the source signal line driver circuit 805 and the gate signal line driver circuit 806 of the display 801 are inputted by a display controller 820.

Configurations of the signal control circuit 819 and the display controller 820 will be described.

Note that the source signal line driver circuit 805 of the display 801 includes a shift register 810, a LAT (A) 811, and a LAT (B) 812. In addition, although not shown, a level shifter, a buffer, or the like may also be provided. The invention is not limited to the above-described configuration.

The signal control circuit 819 includes a CPU 815, a memory A 816, a memory B 817, and a memory controller 818.

A digital video signal inputted to the signal control circuit 819 is inputted to the memory A 816 through a switch controlled by the memory controller 818. Here, the memory A 816 has capacitance capable of storing the 4-bit digital video signals for all pixels of a pixel area 804 of the display 801. When signals for one frame period are stored in the memory A 816, signals for each bit are read out sequentially by the memory controller 818, and then inputted as digital image signals VD to the source signal line driver circuit 805.

As reading of the signals stored in the memory A 816 starts, a digital video signal corresponding to the next frame period starts to be inputted to the memory B 817 via the memory controller 818 and stored. Similarly to the memory A 816, the memory B 817 also has capacitance capable of storing 4-bit digital video signals for all the pixels of the display device.

As described above, the signal control circuit 819 includes the memory A 816 and the memory B 817 each of which is capable of storing a 4-bit digital video signal for one frame period. Digital video signals are sampled using the memory A 816 and the memory B 817 alternately.

The signal control circuit 819 which stores signals by alternately using the two memories of the memory A 816 and the memory B 817 is described here; however, the number of memories is not limited to two.

Using such a display device, the number of signal writings into a pixel can be reduced by a time grayscale method, and power consumption can be reduced. Further, a frame memory can be reduced or eliminated. Moreover, using such a display device of the invention, false contour can be reduced, in addition to the above advantages.

This application is based on Japanese Patent Application serial no. 2005-307906 filed in Japan Patent Office on Oct. 21, 2005, the entire contents of which are hereby incorporated by reference.

What is claimed is:

1. A method for driving a display device which comprises a light emitting element comprising:

selecting a first driving transistor during a first writing period by selecting a gate scan line connected to a gate terminal of a third switching transistor so as to turn on the third switching transistor and so as to input a first signal to a gate terminal of the first driving transistor from a first source signal line through the third switching transistor so that the light emitting element emits light; and selecting a second driving transistor during a second writing period after the first writing period by selecting the gate scan line connected to a gate terminal of a fourth switching transistor so as to turn on the fourth switching transistor and so as to input a second signal to a gate terminal of the second driving transistor from a second source signal line through the fourth switching transistor so that the light emitting element emits light, wherein a first terminal of the first driving transistor is connected to a power supply line, wherein a second terminal of the first driving transistor is connected to a first terminal of a first switching transistor, wherein a second terminal of the first switching transistor is connected to the light emitting element, wherein a gate terminal of the first switching transistor is connected to a first gate signal line, wherein a first terminal of the second driving transistor is connected to the power supply line, wherein a second terminal of the second driving transistor is connected to a first terminal of a second switching transistor, wherein a second terminal of the second switching transistor is connected to the light emitting element, wherein a gate terminal of the second switching transistor is connected to a second gate signal line, wherein the gate terminal of the first driving transistor is connected to a first terminal of the third switching transistor, wherein a second terminal of the third switching transistor is connected to the first source signal line, wherein the gate terminal of the second driving transistor is connected to a first terminal of the fourth switching transistor, wherein a second terminal of the fourth switching transistor is connected to the second source signal line, wherein the display device comprises a signal line driver circuit, wherein a signal is inputted to the signal line driver circuit by a signal control circuit, wherein the signal control circuit comprises a first memory and a second memory, wherein each of the first memory and the second memory is capable of storing a digital video signal for one frame period, wherein the digital video signal is sampled by using the first memory and the second memory alternately, wherein one frame period comprises a first subframe period and a second subframe period, wherein the first subframe period comprises the first writing period, and wherein the second subframe period comprises the second writing period.

2. The method for driving a display device which comprises a light emitting element according to claim 1, wherein a circuit comprising the first driving transistor, the first switching transistor, and the third switching transistor has a same configuration as a circuit comprising the second driving transistor, the second switching transistor, and the fourth switching transistor.

3. The method for driving a display device which comprises a light emitting element according to claim 1, wherein a first circuit comprises the first driving transistor, the first switching transistor, and the third switching transistor, wherein a second circuit comprises the second driving transistor, the second switching transistor, and the fourth switching transistor, and wherein the second circuit retains information to be written next, while the first circuit performs writing.

4. The method for driving a display device which comprises a light emitting element according to claim 1, wherein the first terminal of the first driving transistor is in direct contact with only the power supply line.

5. A method for driving a display device which comprises a light emitting element comprising:

selecting a first driving transistor during a first writing period by selecting a gate scan line connected to a gate terminal of a third switching transistor so as to turn on the third switching transistor and so as to input a first signal to a gate terminal of the first driving transistor from a first source signal line through the third switching transistor so that the light emitting element emits light; and selecting a second driving transistor during a second writing period after the first writing period by selecting the gate scan line connected to a gate terminal of a fourth switching transistor so as to turn on the fourth switching transistor and so as to input a second signal to a gate terminal of the second driving transistor from a second source signal line through the fourth switching transistor so that the light emitting element emits light, wherein a first terminal of the first driving transistor is connected to a power supply line, wherein a second terminal of the first driving transistor is connected to a first terminal of a first switching transistor, wherein a second terminal of the first switching transistor is connected to the light emitting element, wherein a gate terminal of the first switching transistor is connected to a first gate signal line, wherein a first terminal of the second driving transistor is connected to the power supply line, wherein a second terminal of the second driving transistor is connected to a first terminal of a second switching transistor, wherein a second terminal of the second switching transistor is connected to the light emitting element, wherein a gate terminal of the second switching transistor is connected to a second gate signal line, wherein the gate terminal of the first driving transistor is connected to a first terminal of the third switching transistor, wherein a second terminal of the third switching transistor is connected to the first source signal line, wherein the gate terminal of the second driving transistor is connected to a first terminal of the fourth switching transistor, wherein a second terminal of the fourth switching transistor is connected to the second source signal line, wherein the display device comprises a signal line driver circuit, wherein a signal is inputted to the signal line driver circuit by a signal control circuit, wherein the signal control circuit comprises a first memory and a second memory, wherein each of the first memory and the second memory is capable of storing a digital video signal for one frame period, wherein the digital video signal is sampled by using the first memory and the second memory alternately, wherein a first display period after the first writing period and a second display period after the second writing period satisfy 1:2, wherein one frame period comprises a first subframe period and a second subframe period, wherein the first subframe period comprises the first writing period, and wherein the second subframe period comprises the second writing period.

6. The method for driving a display device which comprises a light emitting element according to claim 5, wherein a circuit comprising the first driving transistor, the first switching transistor, and the third switching transistor has a same configuration as a circuit comprising the second driving transistor, the second switching transistor, and the fourth switching transistor.

7. The method for driving a display device which comprises a light emitting element according to claim 5, wherein a first circuit comprises the first driving transistor, the first switching transistor, and the third switching transistor, wherein a second circuit comprises the second driving transistor, the second switching transistor, and the fourth switching transistor, and wherein the second circuit retains information to be written next, while the first circuit performs writing.

8. The method for driving a display device which comprises a light emitting element according to claim 5, wherein the first terminal of the first driving transistor is in direct contact with only the power supply line.

* * * * *